US009752820B2

(12) United States Patent
Yang

(10) Patent No.: US 9,752,820 B2
(45) Date of Patent: Sep. 5, 2017

(54) REFRIGERATOR WITH A DETACHABLE WATER TANK

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 14/591,697

(22) Filed: Jan. 7, 2015

(65) Prior Publication Data

US 2016/0131418 A1 May 12, 2016

(30) Foreign Application Priority Data

Nov. 6, 2014 (KR) ..... 10-2014-0153698

(51) Int. Cl.

| | |
|---|---|
| ***F25D 23/12*** | (2006.01) |
| ***B67D 1/08*** | (2006.01) |
| ***B67D 1/00*** | (2006.01) |
| ***B67D 1/07*** | (2006.01) |
| ***B65B 31/04*** | (2006.01) |

(52) U.S. Cl.

CPC ..... *F25D 23/126* (2013.01); *B65B 31/044* (2013.01); *B67D 1/0009* (2013.01); *B67D 1/07* (2013.01); *B67D 1/0878* (2013.01); *B67D 1/0888* (2013.01); *B67D 2001/075* (2013.01); *F25D 2323/121* (2013.01); *F25D 2323/122* (2013.01)

(58) Field of Classification Search

CPC ..... F25D 23/00; F25D 23/02; F25D 23/04; F25D 23/126; F25D 2323/122; F25D 25/00; F25D 11/00; F25D 11/02; F25D 19/00; B67D 1/0009; B67D 1/07; B67D 1/0878; B67D 1/0888; B67D 2001/075

See application file for complete search history.

(56) References Cited

U.S. PATENT DOCUMENTS

| | | | | |
|---|---|---|---|---|
| 5,768,905 | A * | 6/1998 | Oh | B67D 1/0858 62/264 |
| 2012/0104021 | A1* | 5/2012 | Cur | F25D 23/126 62/389 |
| 2014/0230481 | A1* | 8/2014 | Yun | F25D 23/126 62/340 |

(Continued)

FOREIGN PATENT DOCUMENTS

| | | |
|---|---|---|
| JP | H09-155369 | 6/1997 |
| KR | 20-0141879 | 6/1999 |

(Continued)

OTHER PUBLICATIONS

Machine Translation for KR 20110072369 (A).*

(Continued)

*Primary Examiner* — Nicholas J Weiss

(57) ABSTRACT

A refrigerator equipped with a water tank that is easily accessible to a user and a method of using the same. A water dispenser is installed on the front side of a refrigerator. A water tank coupled to the water dispenser is detachably installed on a lower inner inside of a refrigerator door such that a user can conveniently observe the state of the water tank and access the water tank for maintenance and refill thereof.

3 Claims, 11 Drawing Sheets

(56) References Cited

U.S. PATENT DOCUMENTS

2014/0298836 A1* 10/2014 Oral ..... C02F 1/325
62/132

FOREIGN PATENT DOCUMENTS

| | | | | |
|---|---|---|---|---|
| KR | 10-2006-0027466 | | 3/2006 | |
| KR | 10-2008-0024924 | A | 3/2008 | |
| KR | 10-2008-0081457 | | 9/2008 | |
| KR | 10-2011-0072369 | | 6/2011 | |
| TR | WO 2012035002 | A2 * | 3/2012 | ..... F25D 23/126 |

OTHER PUBLICATIONS

Yoo, Dong Yeol; Water Tank Mounting Structure of Refrigerator Having Opening/Closing Door, Abstract of KR 10-2005-0051980; Jun. 2, 2010, http://kpa.kipris.or.kr.

* cited by examiner

REFRIGERATOR WITH A DETACHABLE WATER TANK

CROSS-REFERENCE TO RELATED APPLICATIONS

This application claims priority and benefit from Korean Patent Application No. 10-2014-0153698, filed on Nov. 6, 2014, with the Korean Intellectual Property Office, the disclosure of which is incorporated herein in its entirety by reference.

TECHNICAL FIELD

Embodiments of the present disclosure relate to refrigerators, and more specifically, to a method of controlling and using refrigerators.

BACKGROUND

In general, a refrigerator is an apparatus for preserving food and other items in a cool or a frozen state by circulating cold air that is generated via a cooling system.

Typically, a refrigerator has a freezing chamber and a refrigerating chamber disposed at the upper and lower sides of the refrigerator, respectively. Recently, refrigerators with two storage chambers disposed side-by-side are also available on the market. Such a side-by-side refrigerator is often equipped with a water dispenser coupled to a water purifier and used to supply drinking water (water or any beverage which is consumable or may be used to cook food) or ice.

As illustrated in FIG. 1, a refrigerator 100 in the related art includes a main frame 110 having a machine chamber (not illustrated), a freezing chamber 120, and a refrigerating chamber 130. A freezing chamber door 122 and a refrigerating chamber door 132 are hingedly coupled to the main frame 110.

A water supply valve (not illustrated) is provided in the machine chamber formed behind the main frame 110.

A dispenser 124 for dispensing drinking water is disposed at the front side of the freezing chamber door 122. A water tank 140 for storing drinking water supplied to the dispenser 124 is provided behind a refrigerator drawer 130. The water supply pipe 153 is coupled to the water tank 140 via the water supply valve. The other end of the water tank 140 is coupled to a water drain pipe 155 used to supply drinking water to the dispenser 124.

However, according to a refrigerator in the related art, the water tank is usually designed to be enclosed in a case disposed in the machine chamber. It is difficult for a user to locate and access the water tank for maintenance or replacement. Further, the structure of the water tank makes it difficult for a user to replace the water tank. Accordingly, a user cannot easily remove unwanted foreign substances accumulated on the water tank, such as substances produced by the dispenser or the ice maker.

LITERATURE OF RELATED ART

Patent Literature

Korean Patent No. 0630910 (LG Electronics Co., Ltd.) (Sep. 26, 2006). Patent Literature 1 relates to a structure for installing a water tank of a refrigerator, and discloses that the water tank is installed in a freezing chamber door in order to supply cool water at a low temperature.

SUMMARY

Embodiments of the present disclosure are directed to providing a refrigerator having a water tank that can be easily detached from the refrigerator for maintenance.

An exemplary embodiment of the present disclosure provides a refrigerator including: one or more refrigerating chambers and corresponding doors; a dispenser unit which is provided on the refrigerator front door and supplies drinking water to users; and a water tank which supplies water to the dispenser unit, in which the water tank is detachably mounted at a lower end inside the refrigerator door.

The refrigerator may further include: a water outflow line through which water is supplied to the dispenser unit; a water supply line through which water is supplied from a water supply source; and a water tank coupling member with one end coupled to a flexible water supply nozzle, the one end having an inner circumferential surface on which screw threads are formed, and the other end which is coupled with the water outflow line and the water supply line, in which screw threads are formed on the outer circumferential surface at one end of the water tank at which a groove is formed, and coupled by being rotated to the screw threads formed on the inner circumferential surface at the one end of the water tank coupling member.

The refrigerator may further include a water tank fixing member which is fixed to an inner surface of the refrigerator door on which the water tank is installed. The water tank is coupled to the water tank fixing member and thereby to the refrigerator door.

The inner circumferential surface of the water tank fixing member may be formed such that it is conformal to a shape of the outer circumferential surface of the water tank.

The refrigerator may further include a water tank door hingedly coupled to the refrigerator door and for covering the water tank. The water tank door can be made of a transparent material such that the water tank is visible through the cover.

The water tank may be made of a transparent material and installed at a lower end of an accommodating drawer mounted on the inner side of the refrigerator door.

The refrigerator may further include a water drain bolt which is coupled to a water drain groove formed at one end of the water tank.

The refrigerator may further include a sterilizing unit which is installed at a lower inner side of the refrigerator door at which the water tank is installed, and has an ultraviolet ray lamp.

Another exemplary embodiment of the present disclosure provides a method of replacing a water tank for a refrigerator, including: detaching a water tank installed at a lower end inside a refrigerator door from a water tank coupling member by rotating the water tank; cleaning the water tank; inserting a water supply nozzle into the cleaned water tank; and coupling the cleaned water tank to the water tank coupling member by rotating the cleaned water tank.

Yet another exemplary embodiment of the present disclosure provides a method of controlling a refrigerator, including: closing a valve, which is installed on a line through which water is supplied to a water tank installed in a refrigerator, when a water tank replacement button, provided on the refrigerator, is selected; discharging water stored in the water tank through a dispenser unit; detaching the water tank from the refrigerator; cleaning the water tank; coupling the cleaned water tank to the refrigerator; and completing the replacement of the water tank.

The method may further include outputting a message which shows that the water tank can be replaced, when all of the water stored in the water tank is discharged.

The discharging of the water may include: determining whether there is a container that receives water discharged from the dispenser unit; and outputting an error message when there is no container, and discharging water stored in the water tank through the dispenser unit when the container is present.

According to the refrigerator, the method of controlling the refrigerator, and the method of replacing the water tank for a refrigerator, according to the present disclosure, the water tank may be detachably coupled at the lower end inside the refrigerator door, thereby allowing the user to easily replace the water tank.

Since the water tank is installed on the inner surface of the refrigerator door, the user may easily confirm a position of the water tank. In particular, the water tank is installed at the lower end of the accommodating drawer of the refrigerator door which is a region that is not mainly used by the user, thereby allowing the user to easily confirm the position of the water tank without inconveniencing the user when the user uses the refrigerator.

Since the water tank door, which covers the water tank, is made of a transparent material, the user may easily confirm a state of the water tank, thereby allowing the user to easily confirm whether foreign substances, which are naturally produced when the dispenser has been used for a long period of time, are present in the water tank. The water tank can be made of a transparent material, thereby allowing the user to easily confirm a degree of contamination of water stored in the water tank.

The sterilizing unit is installed on the inner surface of the refrigerator door on which the water tank is installed, whereby water stored in the water tank is sterilized using an ultraviolet ray that is emitted from the sterilizing unit to the water tank.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

A refrigerator according to an exemplary embodiment of the present disclosure will be described with reference to FIGS. 2 and 3.

Figure 1:
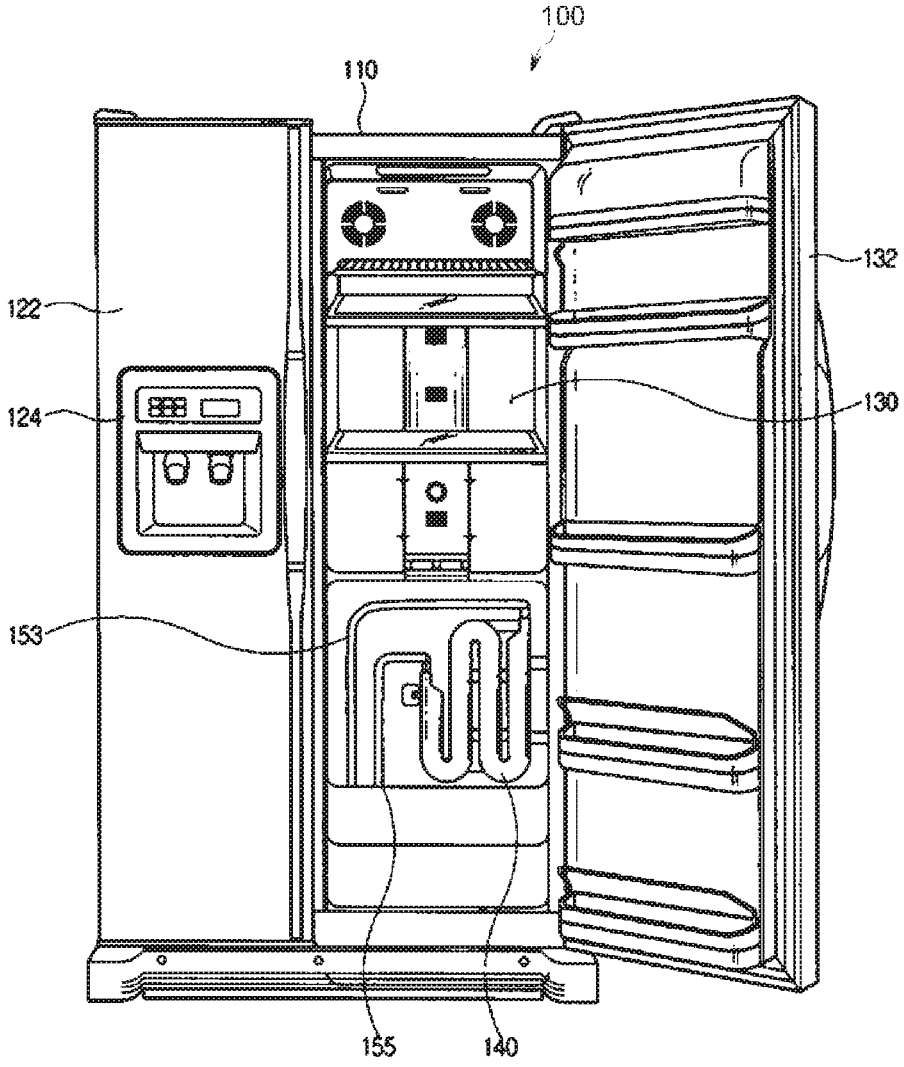
FIG. 1 (PRIOR ART)
FIG. 1 illustrates a perspective view of a refrigerator in the related art.
Figure 2:
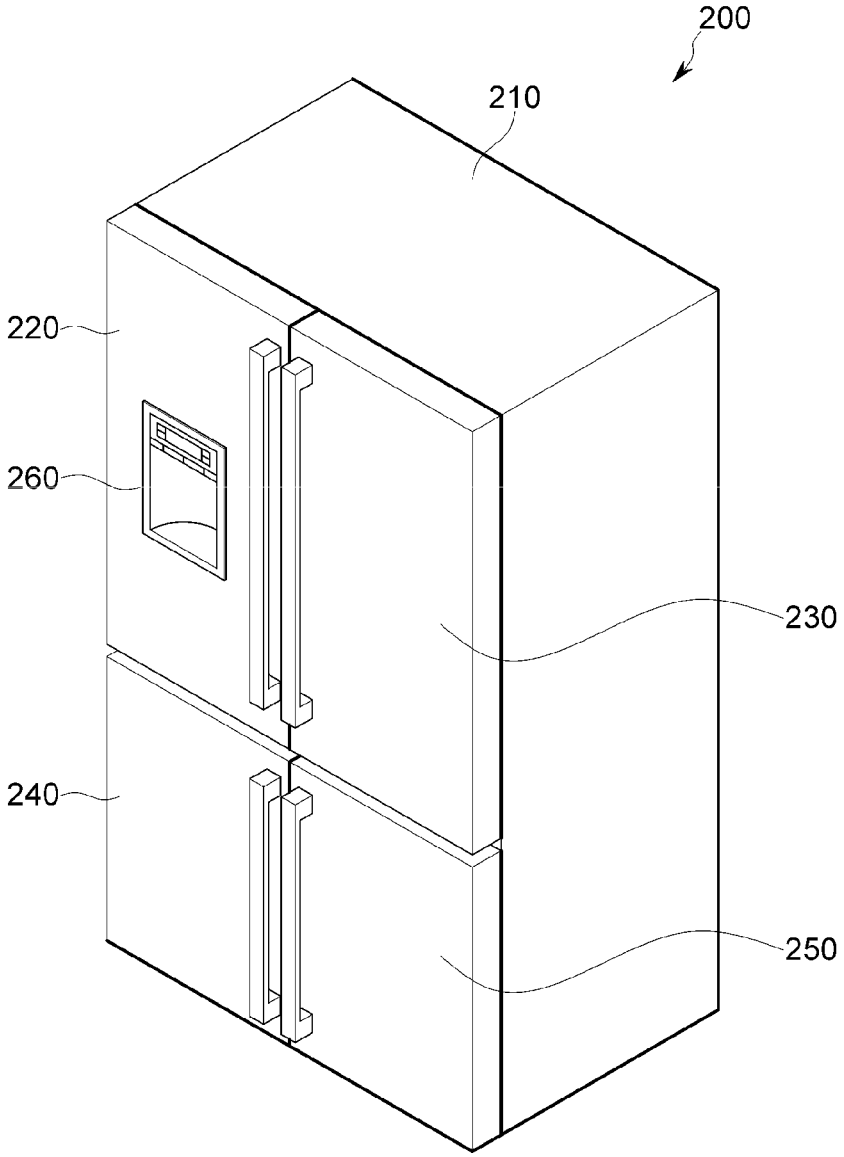
FIG. 2 illustrates a perspective view of an exemplary refrigerator according to an embodiment of the present disclosure.

FIG. 2 illustrates a perspective view of an exemplary refrigerator according to an embodiment of the present disclosure. The refrigerator 200 includes a main frame 210 which has a machine chamber (not explicitly illustrated), a refrigerating chamber (not explicitly illustrated), a freezing chamber (not explicitly illustrated), and a plurality of refrigerator doors 220, 230, 240, and 250 coupled to the main frame 210.

Figure 8:
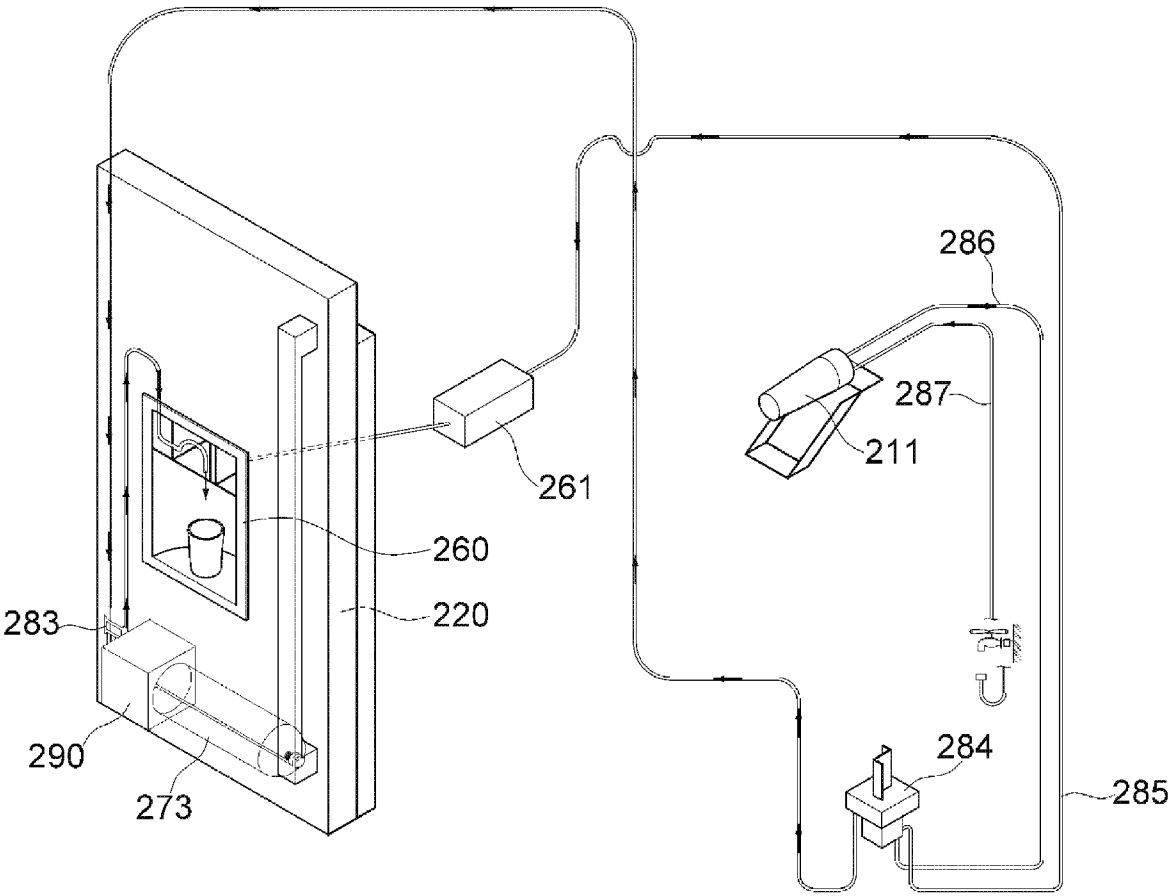
FIG. 8 illustrates the configuration of an exemplary water flow path according to an embodiment of the present disclosure.

A dispenser unit 260 for supplying drinking water (and/or other beverages) is provided on the front side of the first refrigerator door 220. An ice maker 261 as shown in FIG. 8 for making and supplying ice may also be coupled to the dispenser unit 260.

FIG. 2 illustrates an example in which the refrigerator 200 according to the present disclosure has four refrigerator doors, but the present disclosure is not limited thereto. For example, two refrigerator doors may be provided on the upper and lower sides or on the left and right sides of the refrigerator, respectively. A dispenser unit according to the present disclosure may be disposed in anyone of the refrigerator doors.

Figure 3:
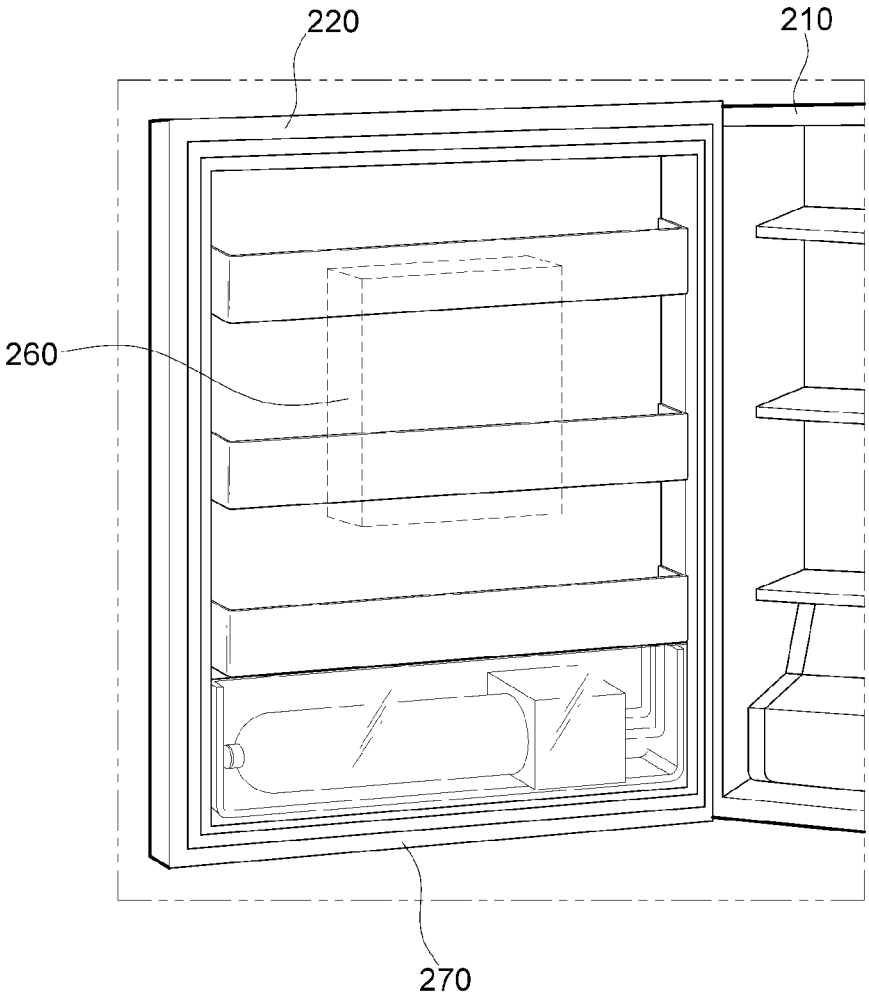
FIG. 3 illustrates an exemplary refrigerator door installed with a water tank according to an embodiment of the present disclosure.

FIG. 3 illustrates an exemplary refrigerator door installed with a water tank according to an embodiment of the present disclosure. The water tank unit 270 is installed on a lower inner side of the first refrigerator door 220, while the dispenser unit 260 is installed on the outer side of the door 220. The water tank unit 270 stores water supplied from a water supply source (not illustrated), and supplies the stored water to the dispenser unit 260. Here, water supplied from the water supply source may be supplied to the water tank unit 270 after being purified by a filter unit 211. Since the water tank is disposed on the inner side of the refrigerator door, it is easily visible to a user.

The water tank unit 270 may be installed on a storage compartment installed on the first refrigerator door 220. As described above, the water tank is installed below the lowest drawer of the refrigerator door 220. This is a region that is not frequently used by a user, thereby allowing the user to easily locate the water tank without causing any inconvenience for users to use the refrigerator.

An exemplary water tank unit according to the present disclosure will be described in more detail with reference to FIGS. 4 to 7.

Figure 4:
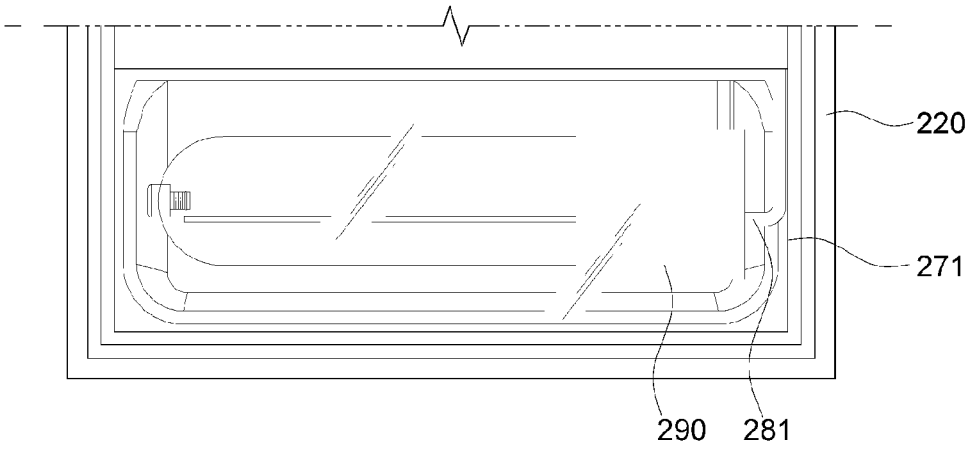
FIG. 4 illustrates the configuration of an exemplary water tank covered with a water tank door in the open state the according to the exemplary embodiment of the present disclosure.
Figure 5:
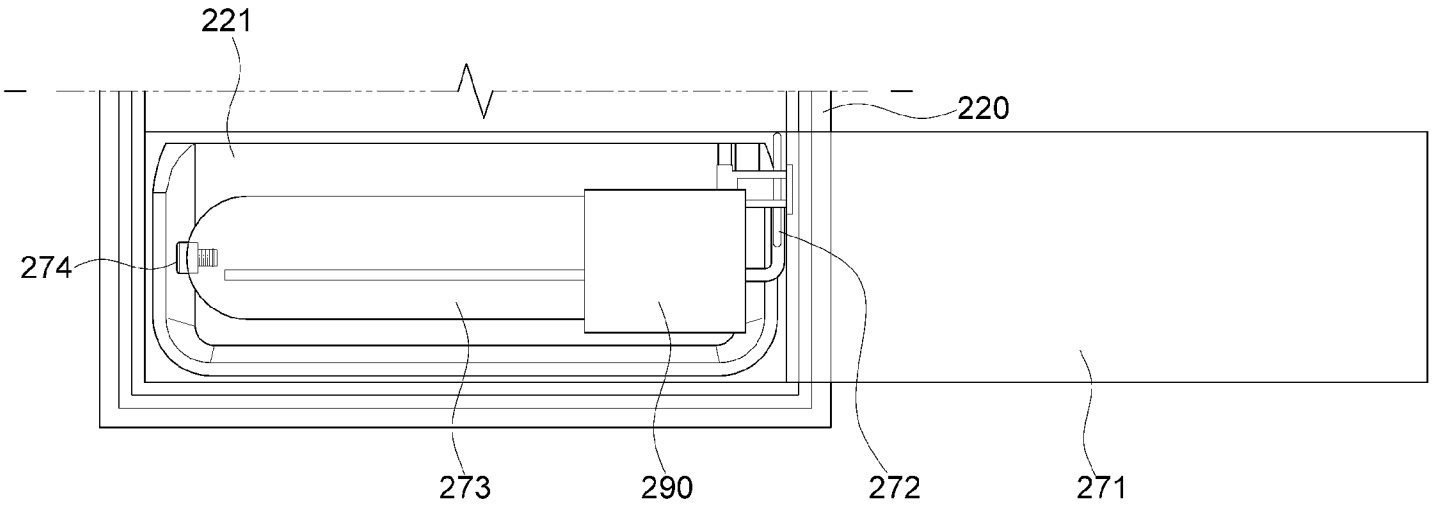
FIG. 5 illustrates the configuration of an exemplary water tank covered with a water tank door in the closed state according to the exemplary embodiment of the present disclosure.
Figure 6:
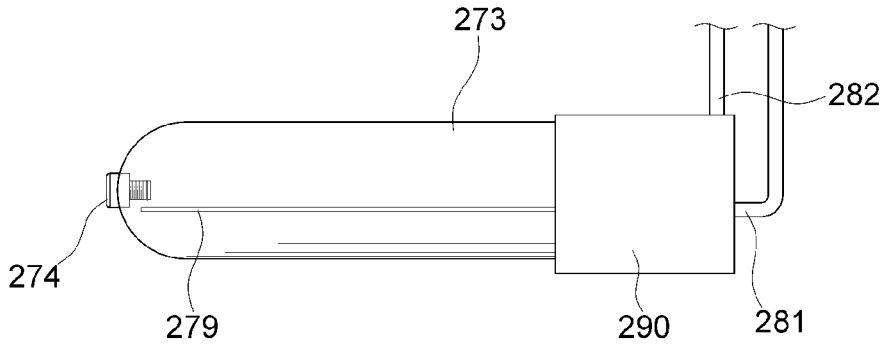
FIG. 6 illustrates the configuration of the exemplary water tank in FIG. 5.

FIG. 4 illustrates the configuration of an exemplary water tank covered with a water tank door being in the open state the according to the exemplary embodiment of the present disclosure. FIG. 5 illustrates the configuration of an exemplary water tank covered with a water tank door being in the closed state according to the exemplary embodiment of the present disclosure. FIG. 6 illustrates the configuration of the exemplary water tank in FIG. 5.

Referring to FIGS. 4 to 6, the water tank unit 270 is installed on the inner surface of the first refrigerator door 220. The unit 270 includes a water tank door 271, a door coupling member 272, a water tank 273, a water drain bolt 274, and a water tank coupling member 290.

The water tank door 271 is coupled to the first refrigerator door 220 via the door coupling member 272 and may be used to cover the water tank 273.

The water tank door 271 can be made of a transparent material such that a user can easily see through the cover and locate the water tank 273 and identify the state of the water tank. Based on the observed state, the user can determine whether or when maintenance is needed, such as removal of the unwanted foreign substances deposited on the water tank after the dispenser is used for an extended time. Further, the transparent material allows a user to see the water stored in the water tank 273 and determine whether the water has been contaminated.

The water tank 273 is coupled with a water supply line through which water is supplied to the water tank 273 via the water tank coupling member 290. The water tank is also coupled with a water outflow line through which water is supplied to the dispenser unit 260. A groove may be formed on one end of the water tank 273, and screw threads may be formed on an outer circumferential surface of the end with the groove.

A water supply nozzle 279 made of a flexible material may be provided at one end of the water tank coupling member 290. Screw threads may be formed on an inner circumferential surface of the water tank coupling member 290 such that the water tank coupling member 290 is coupled to the water tank 273. The other end of the water tank coupling member 290 may be coupled with a first water supply line 281 through which water is supplied to the tank, and coupled with a water outflow line 282 through which water is supplied to the dispenser unit 260.

That is, the screw threads formed on the outer circumferential surface at the one end of the water tank 273 and the screw threads formed on the inner circumferential surface at the one end of the water tank coupling member 290 engage with each other. As a result, the water tank 273 may be fixed to the first refrigerator door 220.

A water drain groove is formed on the other side of the water tank 273, and the water drain bolt 274 may be coupled to the water drain groove of the water tank 273. The user may easily drain the water from the water tank 273 by removing the water drain bolt 274 that is coupled to the water drain groove of the water tank 273 as described above.

Figure 7:
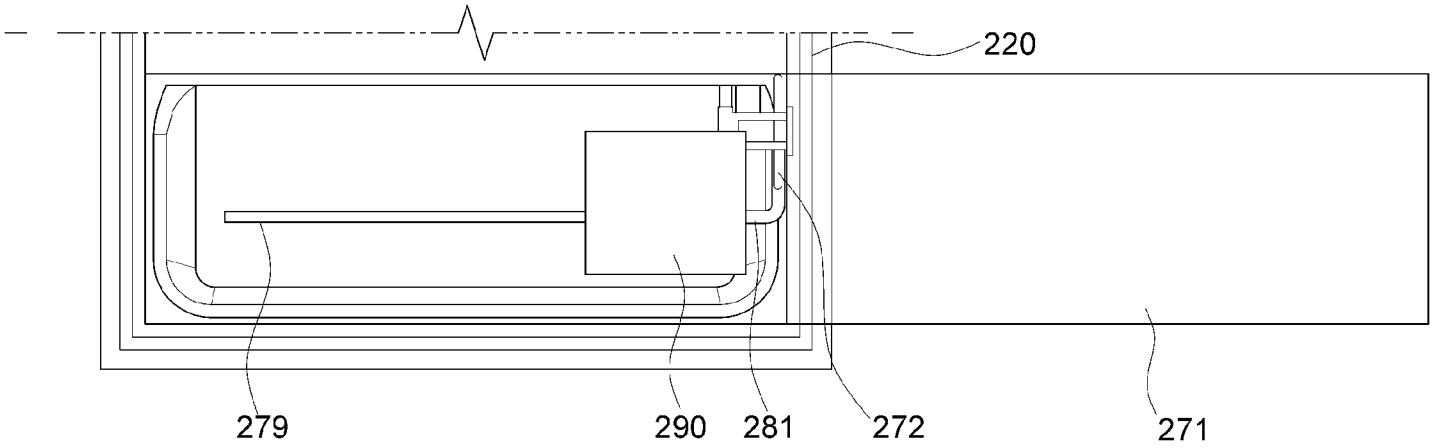
FIG. 7 illustrates the configuration of an exemplary refrigerator door when the water tank is detached according to an embodiment of the present disclosure.

FIG. 7 illustrates the configuration of an exemplary refrigerator door when the water tank is detached according to an embodiment of the present disclosure.

The water tank 273 is detachably installed on the inner surface of the first refrigerator door 220, and the water tank 273 may be detached as illustrated in FIG. 7. That is, the water tank 273 may be detached by rotating the water tank 273 in a clockwise or counter-clockwise direction. In this case, since the water supply nozzle 279, which is provided in the water tank coupling member 290, is made of a flexible material, the user may easily detach the water tank. A user may easily mount the water tank 273 onto the inner surface of the first refrigerator door 220 by reverse the operation of detaching the water tank 273.

FIG. 8 illustrates the configuration of an exemplary water flow path according to an embodiment of the present disclosure.

Referring to FIG. 8, the water supply source supplies water to the filter unit 211 through a fourth water supply line 287. Then, the filter unit 211 purifies water that is supplied from the water supply source through the fourth water supply line 287. The filter unit supplies the purified water to a second valve 284 through a third water supply line 286. The second valve 284 supplies water that is supplied from the filter unit 211 through the third water supply line 286 to the ice maker 261 through a second water supply line 285, and supplies water to the water tank 273 through the first water supply line 281. The ice maker 261 makes ice using water, which is supplied from the second valve 284 through the second water supply line 285, and provides ice to users. The water tank 273 stores water, which is supplied from the second valve 284 through the first water supply line 281, and supplies the stored water to the dispenser unit 260 through the water outflow line 282. In this example, a first valve 283 may be installed on the first water supply line 281 and used by a user to shut off water supply. The first valve 283 may be a ball valve. Then, the dispenser unit 260 dispenses drinking water supplied from the water tank 273 through the water outflow line 282.

A water tank unit according to another exemplary embodiment of the present disclosure will be described with reference to FIGS. 9 and 10.

Figure 9:
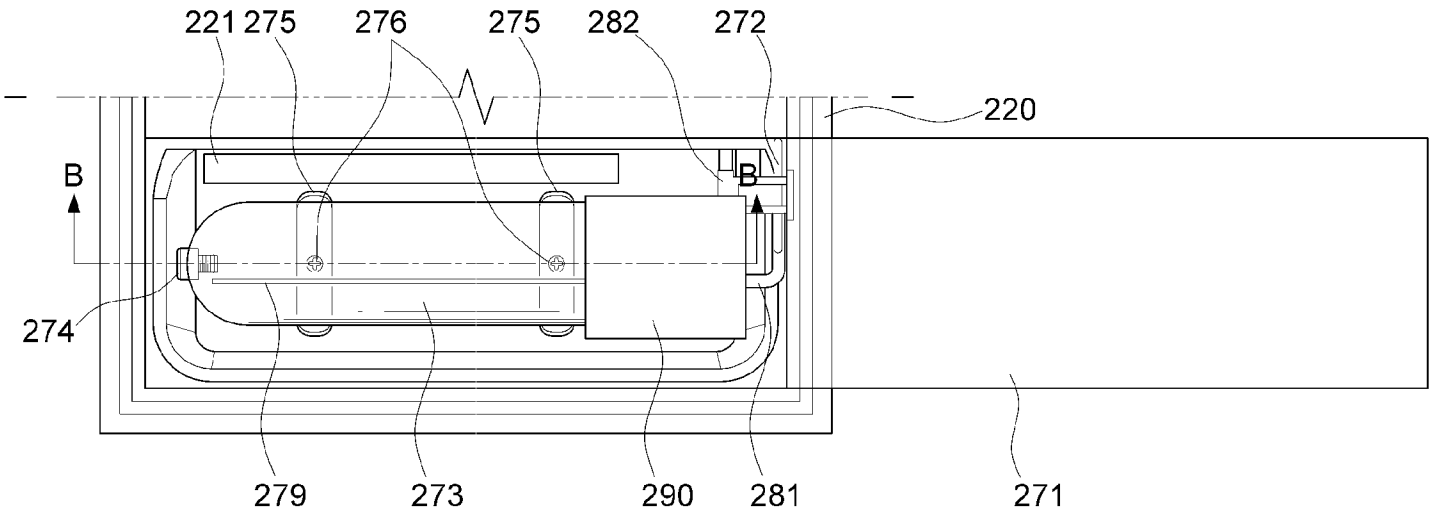
FIG. 9 illustrates the configuration of another exemplary water tank covered with a water tank door in the closed state according to the exemplary embodiment of the present disclosure.

FIG. 9 illustrates the configuration of another exemplary water tank covered with a water tank door in the closed state according to an exemplary embodiment of the present disclosure. FIG. 10 is a cross-sectional view taken along line B-B of FIG. 9.

The water tank unit according to the present embodiment is similar with the water tank unit according to the aforementioned exemplary embodiment. Only the structure for coupling the water tank is different from that in the aforementioned exemplary embodiment.

Figure 10:
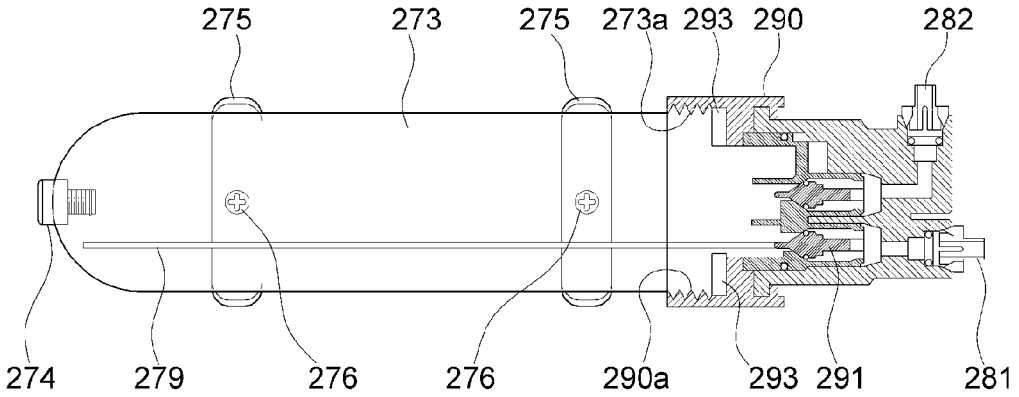
FIG. 10 is a cross-sectional view taken along line B-B of FIG. 9.

Referring to FIGS. 9 and 10, the water tank 273 is coupled with a water supply line via the water tank coupling member 290. The water tank is also coupled to a water outflow line through which water is supplied to the dispenser unit 260. A groove may be formed on one end of the water tank 273, and screw threads 273*a* may be formed on the outer circumferential surface of the groove. A flexible water supply nozzle 279 is disposed on one end of the water tank coupling member 290. Screw threads 290*a* are formed on the inner circumferential surface at the one end of the water tank coupling member 290, such that the water tank coupling member 290 can be screwed onto the water tank 273.

The other end of the water tank coupling member 290 may be coupled with the first water supply line 281, and also coupled with the water outflow line 282 through which water is supplied to the dispenser unit 260. That is, the screw threads 273*a* on the end of the water tank 273 and the screw threads 290*a* on the end of the water tank coupling member 290 engage with each other. Thereby, the water tank 273 can be fixed to the first refrigerator door 220.

In this case, the water tank coupling member 290 may have a gasket 293 disposed on the inner circumferential surface of the end. As described above, the gasket 293 is provided within a region in which the water tank coupling member 290 and the water tank 273 are coupled to each other, thereby preventing water leakage.

The water tank coupling member 290 may have a valve 291 for controlling the water supply.

The water tank 273 according to the present exemplary embodiment may be fitted into and coupled to water tank fixing members 275 that are fixed to the inner side of the first refrigerator door 220. In this manner, to the water tank 273 can be securely fixed to the first refrigerator door 220. Here, the water tank fixing members 275 are coupled to the first refrigerator door 220 using screws 276.

In this case, an inner circumferential surface of the water tank fixing member 275 has a shape conformal to the outer circumferential surface of the water tank 273. For example, as illustrated in FIG. 5, the water tank 273 is cylinder-shaped, and the inner circumferential surface of the water tank fixing member 275 defines a C-shaped space so that the water tank 273 is fitted into the water tank fixing member 275. Although the drawing illustrates that the outer circumferential surface of the water tank 273 is in the 'circular shape' and the inner circumferential surface of the water tank fixing member 275 is in the 'C shape', the present disclosure is not limited thereto. For instance, the water tank and the water tank fixing member may be formed in various other shapes in other embodiments.

The refrigerator 220 according to the present disclosure includes a sterilizing unit 221 installed on the inner surface of the first refrigerator door 220.

The sterilizing unit 221 has an ultraviolet ray lamp to irradiate the water tank 273 using ultraviolet rays. The ultraviolet rays are emitted from the sterilizing unit 221 to the water tank 273 as described above, thereby sterilizing water stored in the water tank.

A method of replacing a water tank for a refrigerator according to the exemplary embodiment of the present disclosure is described with reference to FIG. 11 as follows.

Figure 11:
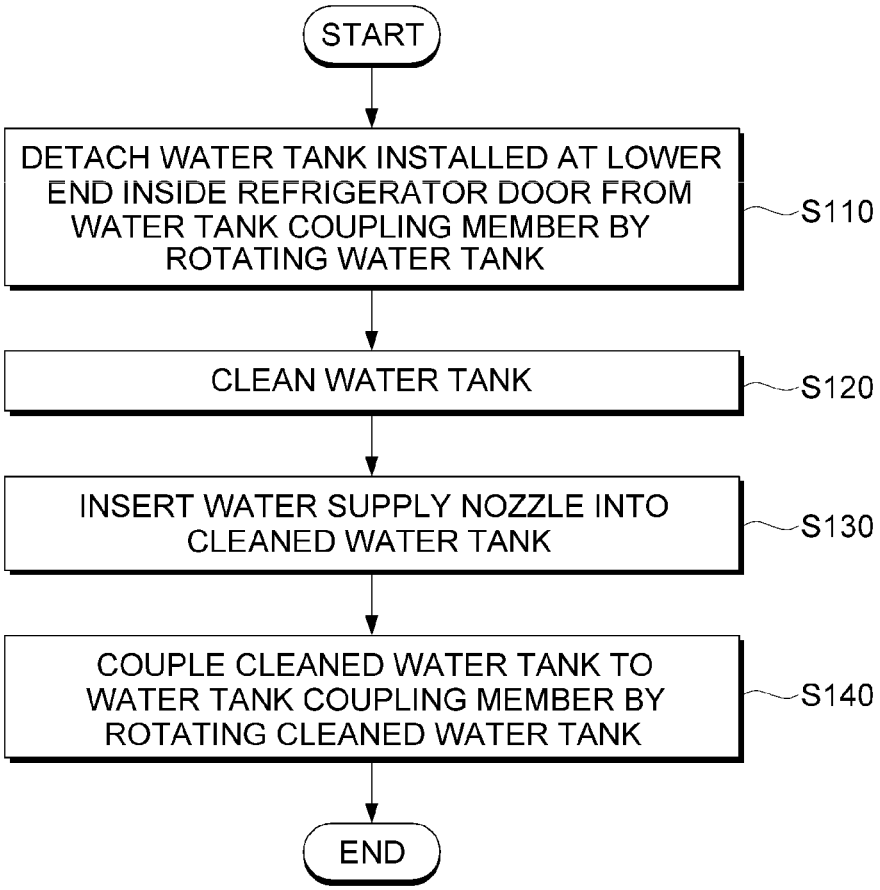
FIG. 11 is a flowchart depicting an exemplary method of replacing a water tank for a refrigerator according to the embodiment of the present disclosure.

FIG. 11 is a flowchart for explaining an exemplary method of replacing a water tank for a refrigerator according to an embodiment of the present disclosure.

Referring to FIG. 11, the water tank 273 installed at the lower side of the refrigerator door 220 is detached from the water tank coupling member 290 by rotating the water tank 273 (S110). Then, the water tank 273 can be cleaned (S120) according to appropriate procedures.

Thereafter, the water supply nozzle 279 is inserted into the cleaned water tank 273 (S130). The cleaned water tank 273 is coupled to the water tank coupling member 290 by rotating the cleaned water tank 273 (S140).

An exemplary method of controlling a refrigerator according to an embodiment of the present disclosure is described as follows. The method relates to replacing a water tank 273 on the refrigerator 200.

When a water tank replacement button on the refrigerator 200 is pressed by a user, the valve is closed. The valve is installed on the first water supply line 281 through which water is supplied to the water tank.

Water stored in the water tank 273 is then discharged through the dispenser unit 260. That is, water stored in the water tank 273 is supplied to the dispenser unit 260 through the water outflow line 282, such that water stored in the water tank 273 can be emptied.

Here, a determination is made with respect to whether there is a container present to receive water discharged from the dispenser unit 260. If there is no container detected, an error message is presented to the user. If a container is detected, water stored in the water tank 273 is discharged through the dispenser unit 260.

When all the water stored in the water tank 273 is empty, an indication may be presented to users indicating the water tank should be replaced. The message may be in the form of a voice message or a text message through a speaker or a display module equipped on the refrigerator 200.

Thereafter, the water tank 273 can be detached from the refrigerator 200 by a user. The water tank 273 can be cleaned and/or refilled and installed back to the refrigerator 200.

As described above, when the water tank 273 mounted in the refrigerator 200 is to be taken off, water stored in the water tank 273 is first discharged to prevent water spill during the detachment operations.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

Reference will now be made in detail to the preferred embodiments of the present disclosure, examples of which are illustrated in the accompanying drawings. While the disclosure will be described in conjunction with the preferred embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of embodiments of the present disclosure, numerous specific details are set forth in order to provide a thorough understanding of the present disclosure. However, it will be recognized by one of ordinary skill in the art that the present disclosure may be practiced without these specific details. In other instances, well-known methods, procedures, components, and circuits have not been described in detail so as not to unnecessarily obscure aspects of the embodiments of the present disclosure. The drawings showing embodiments of the disclosure are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the disclosure can be operated in any orientation.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing terms such as "processing" or "accessing" or "executing" or "storing" or "rendering" or the like, refer to the action and processes of a computer system, or similar electronic computing device, that manipulates and transforms data represented as physical (electronic) quantities within the computer system's registers and memories and other computer readable media into other data similarly represented as physical quantities within the computer system memories or registers or other such information storage, transmission or client devices. When a component appears in several embodiments, the use of the same reference numeral signifies that the component is the same component as illustrated in the original embodiment.

Although certain preferred embodiments and methods have been disclosed herein, it will be apparent from the foregoing disclosure to those skilled in the art that variations and modifications of such embodiments and methods may be made without departing from the spirit and scope of the disclosure. It is intended that the disclosure shall be limited only to the extent required by the appended claims and the rules and principles of applicable law.

What is claimed is:

1. A refrigerator comprising:

a refrigerating chamber configured to store external items placed therein;

a refrigerator door for the refrigerating chamber;

a dispenser unit coupled to the refrigerator door and configured to dispense drinking water and ice;

an ice maker coupled to the dispenser unit and supplying ice to the dispenser unit;

a water tank configured to store and supply water to the dispenser unit;

a water outflow line coupled to the dispenser unit and configured to supply water to the dispenser unit;

a filter unit configured to purify water;

a fourth water supply line coupled to a water supply source and configured to supply water from the water supply source to the filter unit;

a third water supply line to supply water from the filter unit to a second valve;

a second supply line to supply water from the second valve to the ice maker;

a first supply line to supply water from the second valve to the water tank;

wherein the first supply line comprises a first valve configured to shut off the water supply;

a water tank coupling member coupled to a flexible water supply nozzle, wherein the water tank coupling member comprises screw threads on one end, wherein another end of the water tank coupling member is coupled to the water outflow line and the first water supply line;

a water tank door coupled to the refrigerator door and configured to cover the water tank;

a water tank fixing member coupled to the inner side of the refrigerator door and configured to fix the water tank onto the refrigerator door;

wherein the water tank is installed at a lower end of an accommodating drawer that is mounted on an inner side of the refrigerator door, wherein the water tank door comprises a transparent material such that the water tank is visible through the water tank door, wherein the water tank is detachably coupled to the inner side of the refrigerator door and comprises an outer circumferential surface with screw threads, wherein an inner circumferential surface of the water tank fixing member is conformal to the outer circumferential surface of the water tank, and wherein the water tank is coupled to the water tank coupling member by the screw threads on the water tank and the screw threads on the water tank coupling member, and wherein the water tank comprises a transparent material.

2. The refrigerator of claim 1, further comprising:

a water drain bolt coupled to a water drain groove formed on one end of the water tank.

3. The refrigerator of claim 1, further comprising:

a sterilizing unit comprising an ultraviolet ray lamp and coupled to the inner side of the refrigerator door, wherein the sterilizing unit is configured to irradiate the water tank with ultraviolet rays.

* * * * *